US009878233B2

(12) United States Patent
MacIntyre

(10) Patent No.: US 9,878,233 B2
(45) Date of Patent: Jan. 30, 2018

(54) DICE BOARD GAME

(71) Applicant: Dianne Elizabeth MacIntyre, Irvine, CA (US)

(72) Inventor: Dianne Elizabeth MacIntyre, Irvine, CA (US)

( * ) Notice: Subject to any disclaimer, the term of this patent is extended or adjusted under 35 U.S.C. 154(b) by 109 days.

(21) Appl. No.: 14/994,777

(22) Filed: Jan. 13, 2016

(65) Prior Publication Data

US 2016/0136515 A1 May 19, 2016

Related U.S. Application Data

(63) Continuation-in-part of application No. 14/101,906, filed on Dec. 10, 2013, now abandoned.

(60) Provisional application No. 61/735,464, filed on Dec. 10, 2012.

(51) Int. Cl.
*A63F 9/04* (2006.01)
*A63F 3/00* (2006.01)

(52) U.S. Cl.
CPC ..... *A63F 9/04* (2013.01); *A63F 3/0023* (2013.01); *A63F 2009/0471* (2013.01); *A63F 2009/0475* (2013.01); *A63F 2009/0486* (2013.01)

(58) Field of Classification Search
CPC ..... A63F 9/04
USPC ..... 273/146
See application file for complete search history.

(56) References Cited

U.S. PATENT DOCUMENTS 25,701 A * 10/1859 Pattern ..... A41D 1/16 2/216
863,412 A * 8/1907 Macrum ..... A63F 7/044 273/115
1,412,204 A * 4/1922 Derby ..... G09B 17/00 273/146
1,481,628 A * 1/1924 Souza ..... A63F 9/0413 273/146
1,492,737 A 5/1924 Meyer
1,536,672 A 5/1925 Hobbs
1,596,906 A 4/1926 Bouman et al.
(Continued)

OTHER PUBLICATIONS

International Searching Authority Korean Intellectual Property Office, Written Opinion of the International Searching Authority for PCT/US2014/074161, dated Mar. 17, 2014.
(Continued)

*Primary Examiner* — John E Simms, Jr.
*Assistant Examiner* — Dolores Collins
(74) *Attorney, Agent, or Firm* — Kevin Schraven; Lindsey Auerbach; Hankin Patent Law, APC

(57) ABSTRACT

A dice and board game. The game may comprise: a game board, a set of indicator cubes, and four or more saucers. The game board may comprise: a primary playing surface, cubbies, colored sections, an inner wall, and an outer wall. The primary playing surface may comprise a marking and may be surrounded and defined by an inner wall. The cubbies and the colored sections may be located on an outer perimeter of the game board and may be in between the inner wall and the outer wall. The cubbies and the colored sections may alternate along the outer perimeter of the game board and may be separated by partitions. The set of indicator cubes may comprise: color indicator cubes, number indicator cubes, and five sets of colored dice. Each of the color indicator cubes may comprise five colored sides and one symbol side.

10 Claims, 4 Drawing Sheets

(56) References Cited

U.S. PATENT DOCUMENTS 2,178,435 A * 10/1939 Robinson ..... A63F 9/0402 273/148 R
2,549,708 A * 4/1951 Post ..... A63F 3/00006 273/236
3,104,878 A * 9/1963 Roger ..... A63F 3/00075 273/265
3,208,754 A * 9/1965 Sieve ..... A63F 9/0415 273/146
3,481,605 A * 12/1969 Janiszewski ..... A63F 3/00082 124/36
3,560,127 A 2/1971 Imperato
3,645,533 A 2/1972 Lester
3,904,208 A 9/1975 Grossman
4,089,527 A * 5/1978 Roth ..... A63F 3/0478 273/249
4,319,754 A * 3/1982 Yaworsky ..... A63F 3/00075 273/241
4,546,978 A 10/1985 David
4,648,602 A * 3/1987 Maroney ..... A63F 9/0402 273/146
4,826,170 A 5/1989 Rattai
4,930,780 A * 6/1990 Goodman ..... A63F 9/0402 273/146
5,176,381 A 1/1993 Winters
5,405,145 A 4/1995 Jones et al.
5,415,413 A 5/1995 Morinich
5,662,330 A 9/1997 Spears
5,775,697 A * 7/1998 Snarli ..... A63F 3/00157 273/118 R
5,909,374 A 6/1999 Matsunaga
6,508,469 B2 1/2003 Promutico
6,612,579 B1 9/2003 Cembruch
RE39,770 E 8/2007 Promutico
7,258,341 B2 8/2007 Pirouzkhah
7,341,250 B2 3/2008 Lewis, Jr.
7,494,124 B2 2/2009 Hole
7,810,813 B2 * 10/2010 Denoual ..... A63F 9/0402 273/146
7,967,293 B2 6/2011 Sorge
8,602,415 B1 * 12/2013 Denoual ..... A63F 9/04 273/146
8,641,512 B2 2/2014 Hsu
2005/0082749 A1 4/2005 Pirouzkhah
2007/0029726 A1 * 2/2007 Ohira ..... A63F 9/0402 273/145 R
2007/0138742 A1 6/2007 Pirouzkhah
2007/0194527 A1 8/2007 Lewis
2008/0036144 A1 * 2/2008 Maling ..... A63F 3/00157 273/146
2008/0203663 A1 8/2008 Pirouzkhah et al.
2009/0322024 A1 12/2009 Sorge
2011/0001287 A1 * 1/2011 Francis ..... A63F 3/00094 273/271
2011/0300921 A1 * 12/2011 Peterson ..... A63F 9/0415 463/22
2012/0004023 A1 1/2012 Hsu
2013/0130776 A1 5/2013 Hsu

OTHER PUBLICATIONS

International Searching Authority Korean Intellectual Property Office, International Search Report for PCT/US2014/074161, dated Mar. 17, 2014.

* cited by examiner

DICE BOARD GAME

CROSS-REFERENCE TO RELATED APPLICATIONS

This Application is a Continuation-in-Part of U.S. Non-Provisional patent application Ser. No. 14/101,906, filed on Dec. 10, 2013, titled "Greshem Dice/Board Game," by sole inventor Dianne Elizabeth MacIntyre-Melody, the contents of which are expressly incorporated herein by this reference as though set forth in their entirety and to which priority is claimed. U.S. Non-Provisional patent application Ser. No. 14/101,906 also claims the benefit of U.S. Provisional Patent Application No. 61/735,464, filed on Dec. 10, 2012, titled "Gresham Dice/Board Game," by sole inventor Dianne Elizabeth Melody, the same inventor as in U.S. Non-Provisional patent application Ser. No. 14/101,906, and in this Continuation-in-Part Application.

FIELD OF USE

The present disclosure relates to a cube-based matching game. More particularly, the present disclosure relates to various score-keeping games using a combination of colored dice, colored cubes and numbered cubes.

BACKGROUND

Dice have been commonly used for various games. Many game variations require the use of dice with various other game pieces or game boards. Other games use specialized dice and other complicated equipment. Oftentimes the specialized dice and game pieces are only usable for the specific game for which they were designed. Moreover, many games have complicated rules or require formulaic or algorithmic understanding, which may not be suitable for all ages. For example, young children may not be able to add, but may be capable of recognizing patterns and matching colors and/or numbers.

Thus, there is a need for game pieces which may be used for a variety of games, suitable for young children and challenging and engaging to people of all ages.

SUMMARY OF THE EMBODIMENTS

To minimize the limitations in the cited references, and to minimize other limitations that will become apparent upon reading and understanding the present specification, the dice board game disclosed herein preferably allow a user to play a game using colored cubes, along with variations.

In one embodiment, the dice and board game may comprise: a game board, a set of indicator cubes, and four or more saucers. The game board may comprise: a primary playing surface, a plurality of cubbies, a plurality of colored sections, an inner wall, and an outer wall. The primary playing surface may comprise a marking and may be surrounded and defined by an inner wall. The plurality of cubbies and the plurality of colored sections may be located on an outer perimeter of the game board and may be located in between the inner wall and the outer wall. The plurality of cubbies and the plurality of colored sections may alternate along the outer perimeter of the game board and may be separated by a plurality of partitions. The set of indicator cubes may comprise: a plurality of color indicator cubes, a plurality of number indicator cubes, and five sets of colored dice. Each of the plurality of color indicator cubes may comprise five colored sides and one symbol side. Each of the five color sides may be a different color. Each side of the plurality of number indicator cubes may have a different number between the numbers 1 and 6. Each of the plurality of cubbies may be configured to receive (a) two or more of the four or more saucers, (b) one of the plurality of color indicator cubes, and (c) one of the plurality of number indicator cubes. Each of the plurality of cubbies may comprise two indicator cube cubbies. One of the two indicator cube cubbies may be configured to hold one of the plurality of color indicator cubes, and the other one of the two indicator cube cubbies may be configured to hold one of the plurality of number indicator cubes. Each of the plurality of cubbies may be configured to receive two or more of the four or more saucers. Each of the plurality of colored sections may be approximately the same size as each other and may be larger than each of the plurality of cubbies, which may also be approximately the same size as each other. The primary playing surface may be configured to receive the five sets of colored dice. Each of the five sets of colored dice may comprise two dice of a same color, and each of the five sets of colored dice may be different colors. The four or more saucers may comprise: a rim and one or more notches where the one or more notches may be equidistantly spaced along the rim of the four or more saucers. The game board may be configured to allow two or more players to play a game. The game may starts with each of the two or more players receiving one of the plurality of color indicator cubes, one of the plurality of number indicator cubes, and at least two saucers of the four or more saucers. The game may continue with each of the two or more players rolling one of the plurality of color indicator cubes and one of the plurality of number indicator cubes, and determining which of the two or more players begins playing first, such that there is a first player and at least one subsequent player. The game board may be configured to allow the first player to simultaneously roll five sets of colored dice onto the primary playing surface. The five sets of colored dice may then be divided into a first subset and a second subset, such that the first subset may comprise scored dice and the second subset may comprise unscored dice. If the first subset comprises no scored dice a turn of the first player may be bunked. If the first subset comprises a plurality of scored dice, the first player may have an option to roll the unscored dice or keep a score related to the scored dice. If the player keeps the score related to the scored dice the turn of the first player may be over. If the first player rolls the unscored dice, the unscored dice may be then divided into a third subset and a fourth subset, such that the third subset may comprise scored dice, which may then be combined with the first subset, and the fourth subset may comprise unscored dice, wherein so long as the third subset comprises at least one scored dice, the first player may continues to have the option to roll the unscored dice or keep the score related to the scored dice. If the third subset comprises no scored dice a turn of the first player may be bunked. Once the turn of the player is over or bunked, play may pass to at least one subsequent player, who may play just as the first player did. The two or more players may agree on a predetermined winning score that must be met exactly to win. A victor may be one of the two or more players that first obtains the predetermined winning score. The game board may be configured to allow the first player to continue their turn after being bunked by using one of at least two saucers received by the first player in association with the marking on the game board. If the first player has used all of the at least two saucers received, an additional saucer may be earned if the first player rolls the five sets of colored dice such that one or more of the colored dice randomly lands within one or more of the colored sections, such that one or more stray colored dice may be created, and such that a color of at least one of the one or more stray colored dice matches a color of the one or more colored sections in which the one or more stray colored dice lands.

In another embodiment, the dice and board game system may comprise: providing a game board, a set of indicator cubes, and four or more saucers. The game board may comprise: a primary playing surface, a plurality of cubbies, a plurality of colored sections, an inner wall, and an outer-wall. The primary playing surface may comprise a marking and may be surrounded and defined by the inner wall. The plurality of cubbies and the plurality of colored sections may be located on an outer perimeter of the game board and may be located in between the inner wall and the outer wall. The plurality of cubbies and the plurality of colored sections may alternate along outer perimeter of the game board and may be separated by a plurality of partitions. The set of indicator cubes may comprise: a plurality of color indicator cubes, a plurality of number indicator cubes, and five sets of colored dice. Each of the plurality of color indicator cubes may comprise five colored sides and one symbol side. Each of the five color sides may be a different color. Each side of the plurality of number indicator cubes may have a different number between the numbers 1 and 6. Two or more players may determine a predetermined winning score. Each of the two or more players may receive: one of the plurality of color indicator cubes, one of the plurality of number indicator cubes, and at least two saucers of the four or more saucers, such that each of the two or more players has one of the plurality of color indicator cubes and one of the plurality of number indicator cubes. Each of the two or more players may roll one of the plurality of color indicator cubes and one of the plurality of number indicator cubes, and may determine which of the two or more players begins playing first, such that there may be a first player and at least one subsequent player. The first player may simultaneously roll the five sets of colored dice onto the primary playing surface. The rolled five sets of colored dice may be divided into a first subset and a second subset, such that the first subset comprises scored dice and the second subset comprises unscored dice. If the first subset comprises no scored dice a turn of the first player may be bunked. If the first subset comprises a plurality of scored dice, the first player may have an option to roll the unscored dice or keep a score related to the scored dice. If the player keeps the score related to the scored dice the turn of the first player may be over. If the first player rolls the unscored dice, the unscored dice may then be divided into a third subset and a fourth subset, such that the third subset may comprise scored dice, which may be then combined with the first subset, and the fourth subset may comprise unscored dice, wherein so long as the third subset comprises at least one scored dice, the first player may continue to have the option to roll the unscored dice or keep the score related to the scored dice. If the third subset comprises no scored dice a turn of the first player may be bunked. Once the turn of the player is over, the play may pass to at least one subsequent player, who may roll the five sets of colored dice just as the first player did. The play may continue to pass between the two or more players until one of the two or more players obtains the predetermined winning score and ends the game. The board and dice game system may further comprise: allowing the first player to continue the turn after being bunked by using one of the at least two saucers received by the first player in association with the marking on the game board. Additionally, the board and dice game system may further comprise: earning an additional saucer by the first player if the first player has used all of the at least two saucers received when the first player rolls the five sets of colored dice such that one or more of the colored dice may land within one or more of the colored sections, such that one or more stray colored dice may be created, and such that a color of at least one of the one or more stray colored dice may match a color of the one or more colored sections in which the one or more stray colored dice lands. The scored dice may comprise one or more triple links. The scored dice may further comprise one or more single hooks. The scored dice may further comprise at least one scoring combination selected from the group of scoring combinations consisting of one or more sparks, a toledo, a holy toledo, a brooklyn, a wild push dice match, and a greshem. The wild push dice match may occur when at least one of the scored dice matches both one of the plurality of color indicator cubes and one of the plurality of number indicator cubes. The rolling of a greshem may win and may end the game. Each of the two or more players may score a minimum opening score in order to begin scoring. After each roll of the unscored dice and after each roll of the complete five sets of colored dice, the scored dice may be scored.

It is an object of the present dice and board game to overcome limitations of the prior art.

Other features and advantages inherent in the dice board game claimed and disclosed will become apparent to those skilled in the art from the following detailed description and its accompanying drawings.

BRIEF DESCRIPTION OF THE DRAWINGS

The features, obstacles, and advantages of the present application will become more apparent from the detailed description set forth below when taken in conjunction with the drawings, wherein.

DETAILED DESCRIPTION OF THE ILLUSTRATIVE EMBODIMENTS

In the following detailed description, numerous specific details are set forth in order to provide a thorough understanding of various aspects of one or more embodiments. However, the one or more embodiments may be practiced without some or all of these specific details. In other instances, well-known methods, procedures, and/or components have not been described in detail so as not to unnecessarily obscure aspects of embodiments.

While multiple embodiments are disclosed, still other embodiments will become apparent to those skilled in the art from the following detailed description. As will be realized, these embodiments are capable of modifications in various obvious aspects, all without departing from the spirit and scope of protection. Accordingly, the screen shots, figures, and the detailed descriptions thereof, are to be regarded as illustrative in nature and not restrictive. Also, the reference or non-reference to a particular embodiment of the invention shall not be interpreted to limit the scope of protection.

Figure 1:
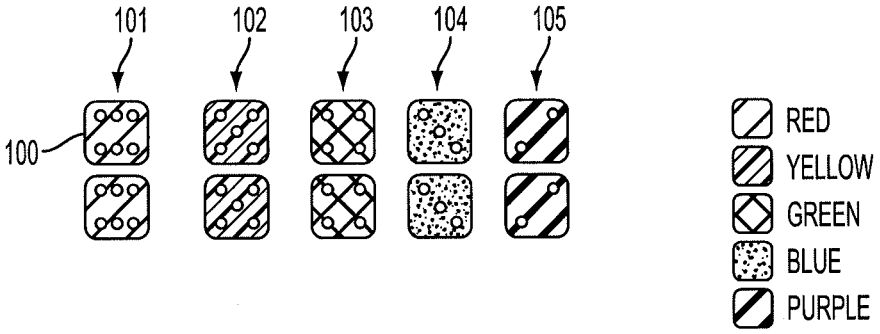
FIG. 1 depicts a set of colored dice according to an implementation of the present disclosure.

FIG. 1-7 depict an exemplary set of game pieces according to one implementation. When not in use, the game pieces of FIGS. 1-7 may be stored and carried in a bag, such as the bag 335 in FIG. 3C. Turning to FIG. 1, FIG. 1 illustrates a set of indicator cubes or color dice 100, which may be 6-sided dice having different colors. More specifically, the set includes a pair of red dice 101, a pair of yellow dice 102, a pair of green dice 103, a pair of blue dice 104, and a pair of purple dice 105. In other implementations other colors may be used. The color dice 100 may all share the same dimensions, are unweighted (i.e. have generally consistent weight distribution throughout), and have indicator values of 1-6, signified by dots, on each side. In other implementations, the color dice 100 may have different sizes or may be weighted, and may have different indicator values, represented by other markings. In other implementations, more or less than a pair of each color may be used. The color dice 100 may be made of non-toxic materials, such as plastic.

Figure 2:
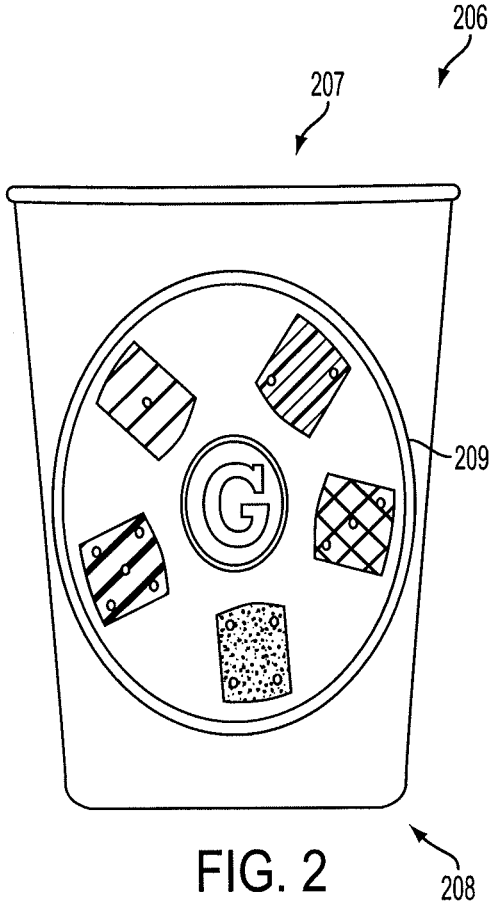
FIG. 2 depicts a container for rolling colored dice, or colored cubes and/or numbered cubes according to an implementation of the present disclosure.

FIG. 2 illustrates a container 206. The container 206 may be referred to as a CupTin©, which may be a cup or similar container having an opening 207, and a base 208, which is closed. A marking 209, which may be a logo, may serve as a label to the container 206. The container 206 may taper from a wider opening 207 to a narrow base 208. The container 206 is used to hold indicator cubes, such as the color dice 100 or other indicator cubes described herein, and allows a player to roll the indicator cubes onto a playing surface. The container 206 allows the player to shake the indicator cubes before rolling, and further allows easier rolling of a large number of indicator cubes, such as the 10 color dice 100 shown in FIG. 1 or color cubes 640 in FIG. 6A and numbered cubes 750 in FIG. 7, described below. The container 206 may be made of non-toxic materials such as plastic.

Figure 3A:
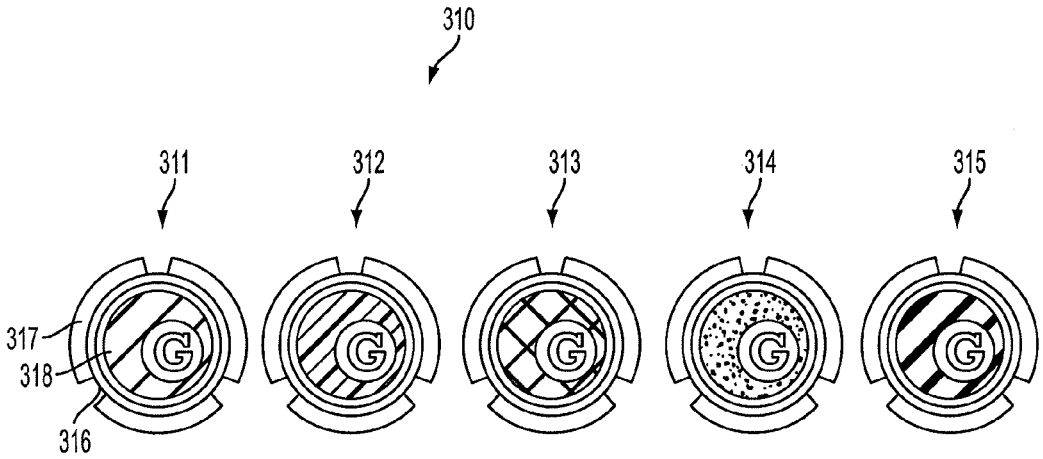
FIG. 3A depicts saucers for re-rolling purposes or for linking together according to an implementation of the present disclosure.

FIG. 3A illustrates a set of saucers 310. Each saucer 310 includes a rim 317 surrounding a recessed surface 318. The rim 317 has one or more notches 316. In FIG. 3A, each saucer 310 has 3 equidistant notches 316. In other implementations, there may be more or less notches 316, which may be located in alternate or non-equidistant positions along the rim 317. The surface 318 may have different colors. FIG. 3A depicts a red saucer 311, a yellow saucer 312, a green saucer 313, a blue saucer 314, and a purple saucer 315. In other implementations, different colors and/or patterns or the same pattern may be used. An exemplary set of saucers 310 may include 25 saucers, for example 5 of each color. However, more or less saucers 310 may be needed for a particular game, depending on the number of players as will be discussed below. The saucer 310 may be made of non-toxic materials such as plastic. The saucers 310 may be stored in a bag 335 in FIG. 3C, or a saucer cubby (such as a saucer cubby 426) in a game board 420, seen in FIG. 4, or other similar storage.

Figure 3B:
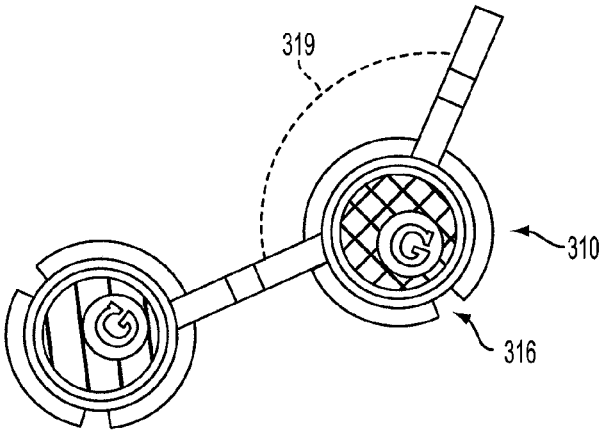
FIG. 3B depicts the saucers of FIG. 3A linked together.

FIG. 3B illustrates an additional feature of the saucers 310. The saucers 310 may be linked together by mating the notches 316. For example, young children capable of snapping items together may build various structures by linking together the saucers 310. The locations of the notches 316 along the rim 317 may determine the types of links, specifically an angle 319 of the links. In FIG. 3B, with three equidistant notches 316, the angle 319 may be 120 degrees. In other implementations, the angle 319 may be different.

Figure 3C:
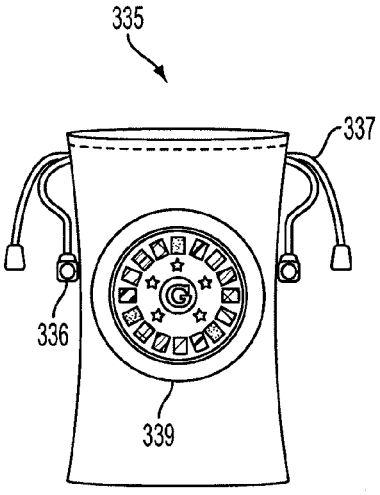
FIG. 3C depicts a bag for holding all game pieces according to an implementation of the present disclosure.

FIG. 3C illustrates the bag 335. The bag 335 may be referred to as a Greshem Gold Bag, which may be a gold colored cloth bag. The bag 335 includes a marking 339, which may be a logo, and is closed by drawstrings 337 having aglets 336. The aglets 336 may be marked similar to the marking 339. The bag 335 may be large enough to carry all required game pieces. In an exemplary implementation, the bag 335 is large enough to carry 10 color dice 100 (FIG. 1), 5 color cubes 640 (FIG. 6A), 5 number cubes (FIG. 7), 25 saucers 310 (FIG. 3A), 1 game coin 530 (FIG. 5), 1 container 206 (FIG. 2), an instruction/rule booklet, a pencil, and a pad. The bag 335 may further hold a game board 420, which may be collapsible.

Figure 4:
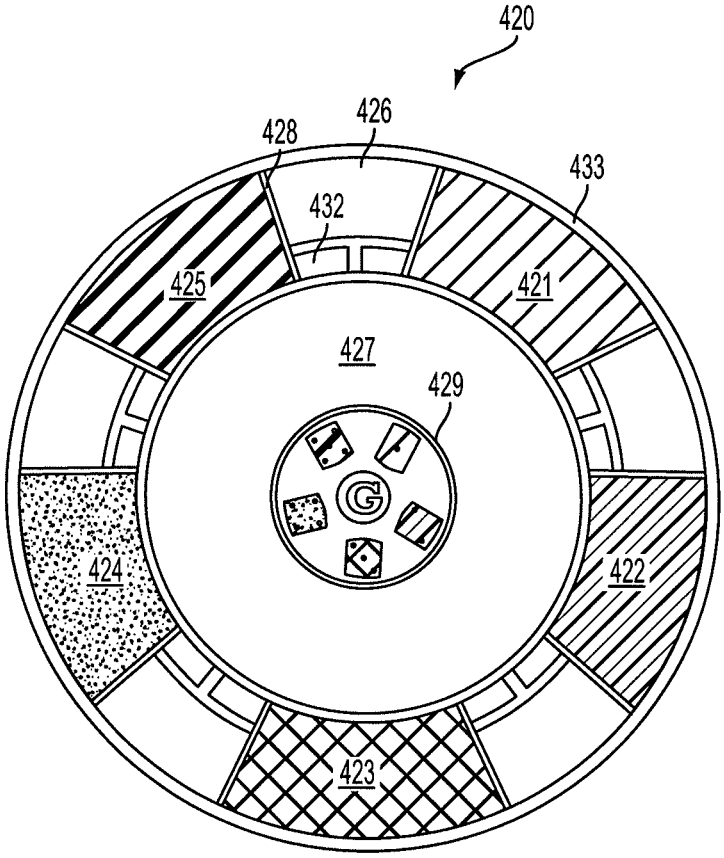
FIG. 4 depicts a game board according to an implementation of the present disclosure.

FIG. 4 depicts a game board 420. The game board 420 is circular, although in other implementations it may take on another shape. The game board 420 includes a central surface 427 which includes a marking 429. The surface 427 is surrounded by saucer cubbies 426, which alternate between a red section 421, a yellow section 422, a green section 423, a blue section 424, and a purple section 425. In other implementations other colors may be used. Each of the sections is separated by walls 428, such that each section provides a partitioned wall in which the scoring indicator cubes may utilized. The game board 420 also includes an outer wall or rim 433. In FIG. 4, the saucer cubbies 426 are smaller than the colored sections, and are utilized by indicator cubes (such as Wild Push Dice described below) and saucers 310, but the sizes may be different or re-sectioned and not equidistant in alternative implementations. The saucer cubbies 426 further includes two dice cubbies 432, for holding indicator cubes. The size of the dice cubby 432 correlates to the size of an indicator cube, whereas the size of the saucer cubby 426 correlates to the size of the saucer 310. The marking 429 may be a logo, a portion of which may light up. For example, the "G" may light up when a saucer 310 lands on it. An online implementation of the marking 429 may be capable of spinning. The marking 429 is an alternative logo to the marking 339 in FIG. 3, and in other implementations the logo of the marking 339 or the marking 429 may be utilized instead. The surfaces of the surface 427, saucer cubbies 426, the red section 421, the yellow section 422, the green section 423, the blue section 424, and the purple section 425 may be made of or lined with fabric, foam or other similar material suitable for receiving the indicator cubes. The underside of the game board 420 may be made of other non-toxic materials, such as plastic. In addition, the game board 420 may be foldable or otherwise collapsible for easier storage, such as to fit within the bag 335.

Figure 5:
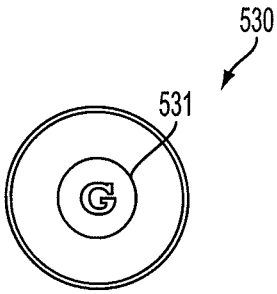
FIG. 5 depicts a game coin according to an implementation of the present disclosure.

FIG. 5 shows a game coin 530. The game coin 530 may have a marking 531, which may be a logo. The game coin 530 may be made of gold faked resin or other similar weighted material. The game coin 530 may be a marker or trophy, as will be described below.

Figure 6A:
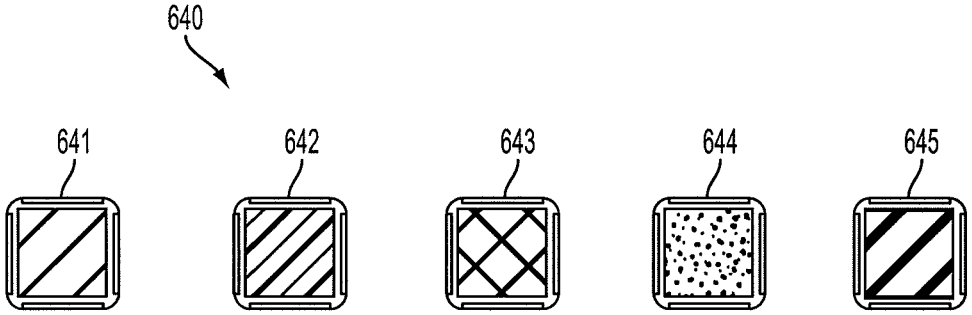
FIG. 6A depicts a set of colored indicator cubes according to an implementation of the present disclosure.

FIG. 6A depicts a set of indicator cubes or color cubes 640, which may share certain characteristics with the color dice 100. The color cubes 640 may have the same general dimensions, composition, and materials as the color dice 100, but may be different in alternative implementations.

Figure 6B:
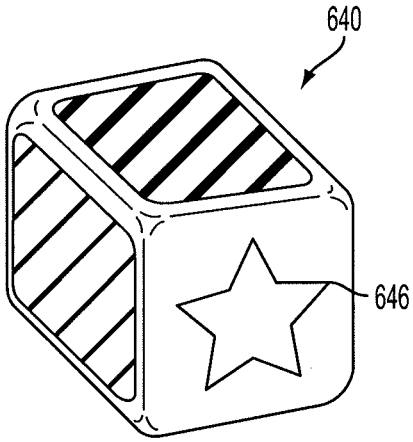
FIG. 6B depicts a perspective (or symbol) view of a colored indicator cube from FIG. 6A.

Although five color cubes 640 is an exemplary set, in other implementations more or less may be needed. Each color cube 640 is a 6-sided cube, with each side having a different color. Each color cube 640 has a red side 641, a yellow side 642, a green side 643, a blue side 644, and a purple side 645. The sixth side may have a symbol or other marking. As seen in FIG. 6B, the color cubes 640 have a star side 646 having a white star, although in other implementations other shapes may be used. The color cubes 640 may be made of a non-toxic material such as plastic.

Figure 7:
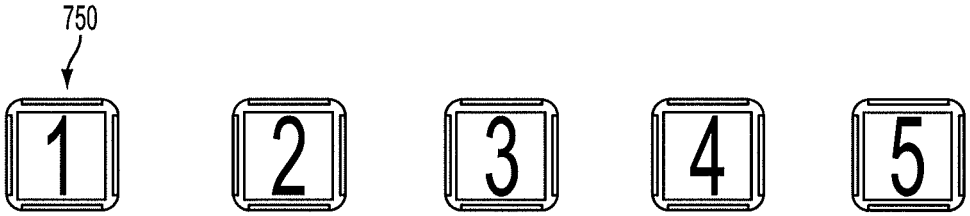
FIG. 7 depicts a set of numbered indicator cubes according to an implementation of the present disclosure.

FIG. 7 depicts a set of 5 indicator cubes or number cubes 750. Although the exemplary set contains 5 number cubes 750, in other implementations more or less may be used. Each side of the number cubes 750 have a number, rather than dots. The numbers may be Arabic numerals, which may aid young children in recognizing the numbers. Although only digits 1-5 are shown, each number cube 750 also has a 6. In other implementations, other digits may be used, and are not restricted to Arabic numerals.

The game pieces described above may be used in dice games, which may be called Greshem Dice© games. In certain implementations, the game pieces described above may be virtual, or represented as images, such as in online implementations. The rules and variations on the rules are described below. Special terms used in the rules are defined in the following glossary.

GLOSSARY

"Brooklyn": Rolling two of the same number chains with a full CupTin 206. A number chain includes 5 color dice 100 having consecutive values, either 1-5 or 2-6.

"Bunk": When the color dice 100 stop scoring, the accumulated total of that roll only is lost, or when the dice score passes the Goal. It is also known as "Bunkie," "Bunker," "Bunked," "Bunk-A-Roonie," etc.

"Cool Grand": Scoring 1,000 points.

"CupTin": The container 206 with all 10 color dice 100 in it, named for a "cup of ten."

"Goal": Scoring the exact mark for the game without going over, to win, or to roll a Greshem.

"Greshem": Rolling ten of the same number, which instantly wins the game.

"Holy Toledo!": From a full CupTin 206, three Links rolled at the same time, with the tenth color dice 100 matching one of the triple link numbers.

"Hooks": A single dice number matching the Link dice numbers.

"Links": Three of the same number.

"Mark": To add your roll total to your score.

"Park": To stop rolling and mark down your score, often called "Park and Mark."

"Post": The minimum amount needed to start scoring in the selected game.

"The Rainbow": A Brooklyn that Sparks.

"The Red Six": Wild red six dice (the red die 101 showing 6), which scores an optional 100 points per R6 die in the Purist Game only.

"Saucers": Game chips (the saucers 310) tossed onto the game board 420 for de-bunking purposes. De-bunking only allows the player to re-roll the color dice 100 that Bunked the player, i.e. the dice that did not score. To add variation to the game, optional rules may be used. When a player is out of saucers 310, and a color dice 100 randomly lands on a partitioned matching color section of the game board 420, the player may have a free de-bunk or an additional saucer 310. Online implementations may have additional options. In the Short Trip and Long Journey games, when a player is out of saucers 310, each player gets one spin of the marking 429 (i.e. the "G" circle) for a chance to win an additional saucer 310 to de-bunk.

Greshem House Rules

"Mitchell": Any time Sparks are possible on the next roll, and one Link and one Hook are rolled, and there are four different colors, the player must designate which colors are in the Triple Link and which color is set aside as a Single Hook. The player cannot change the Link colors on subsequent rolls. Players may also need to Mitchell when two Links are rolled.

Score keeping: Beginners are encouraged to keep track of their own (cumulative) score to better understand the tempo of the selected game, when to toss saucers, and the end game. When a scorekeeper is used, the scorekeeper is not responsible for seeing Sparks or tallying up a player's rolled total.

"Spark'n Toledo": Add Sparks total first, then double all three Links for the total score.

"Toss'n Saucers": When tossing in a Saucer, the player's hand should not cross the outer rim 433 of the game board 420. If the saucer 310 lands on the "G" of the marking 429, the player may keep that saucer 310 for another toss. All Saucers are returned to the Greshem Gold Bag 335 when the game ends.

Tiebreaker: When there is a WPD tie at the start of a game, there are various tiebreakers. Color order is used, in decreasing value, first red, then yellow, green, blue, and purple. If still tied, then one CupTin 206 high roll is used. If still tied, the player having a birthday closes to February 27 is used. If still tied, then any other suitable tiebreaker is used.

"Dice Off the Table": A die may fly off the game board 420 and onto a player's playing surface or the floor. If the player shouts "Greshem" before it lands and shows its number, the player may keep the number. Otherwise, that one die is re-rolled.

Greshem Gold Coin: The game coin 530 may be gold in color. When a Purist (i.e. a player in a Purist rules game) wins the Greshem Gold Coin, the player owns it for as many games until: (a) the player chooses to Toss-A Coin to de-bunk, usually Going for Greshem with "G" board rules in effect; or (b) another Purist rolls a Greshem and the player must relinquish the coin.

Basic Strategy and Notes

Slow and steady: The average roll is usually between 600 and 900. Rolling for big totals every time tends to be a losing strategy.

The End Game: As you approach the Goal, try to leave between 500 and 1000 to hit your Mark. Scoring 700 is easier than scoring 100. A player may want to Bunk on purpose so as not to get too close to the Goal.

Timing: Knowing other players scores may assist in the use of the saucers 310 for de-bunking. If using a scorekeeper, the scorekeeper must let players know all current totals when requested. If scoring separately, each player must reveal their current total when asked. Mid-game tossing of the saucer 310 and late-game tossing of the saucer 310 can change things quickly.

Chatter: Seasoned players may try to convince novice players to Toss-A-Saucer unwisely.

Dice 100 tossing: Seasoned players, when out of saucers 310, may try the "wild roll" when a CupTin 206 gets low, for a possible extra roll. Too many consecutive "Dice Off the Table" rolls and the player should lose their turn. Game players may decide.

Selling Saucers: This may be available in online versions only. Selling a saucer 310 for points is a strategy move between online players. A player (X) may "tap" another player (y) to see if they will sell a saucer 310 for 1000 points. Player (X) loses 1000 points but gains the other player's (y) saucer 310, and the player (y) gains 1000 points but loses that one saucer 310. The exchange must be completed before the player's (X) next roll. A player may not sell a saucer 310 to post, or reach the Goal. Players may also sell their one "G" Circle Spin (i.e. the marking 429) in the same manner for the cost of 500 points.

Note to R6 Purists: If a Purist player's WPD is the R6, that Purist has the option to score all or half of it (i.e. 100), or push it back into the CupTin 206 to re-roll.

Note to scorekeepers: A Greshem tradition involves using a player's initials with the WPD abbreviation.

Greshem Games

"The Short Trip"

A first variation, suitable for beginners, has a Post of 700 and a Goal of 10,000 (without going over). Game play starts with each player rolling for their own WPD, using one color cube 640 and one number cube 750. Each player receives 2 saucers 310. The highest WPD starts, and play continues clockwise.

On a player's turn the player rolls the 10 color dice 100, using the container 206, onto the game board 420. The Post is 700, meaning the player must score at least 700 to start.

Triple Links, which are 3 of the same number, scores with the dice number ×100. For example, three 2's is a score of 200.

Single Hook, which is a single die matching a Link, adds an extra 100. Matching Hooks also score on any subsequent roll until all 10 dice have scored, or the player chooses to Park and Mark. Hooks do not carry over to the next CupTin 206 roll.

WPD is an optional +100 score; the player may push it into the player's tally or push it back into the CupTin 206 and re-roll.

Sparks, when two Links match the same color pattern, the Link score doubles.

Toledo, when three Links are rolled at the same time, the Link score doubles.

Holy Toledo, when the 10th die of a Toledo Hooks, add an extra 200. The Holy Toledo score is unbunkable, even if the player Bunks on the next CupTin 206 roll.

Brooklyn, two chains from a full CupTin 206. The score is unbunkable. If a Brooklyn Sparks, the score is doubled and is also unbunkable.

Toss-A-Saucer, to debunk and roll the dice that did not score. If the saucer 310 lands on the center G of the marking 429, the player keeps the saucer 310. Otherwise, the saucer 310 is used, and returns to the Greshem Gold Bag.

Go for Greshem, when every Link and Hook ultimately rolls the same number. A Greshem wins the game instantly.

As the color dice 100 score, the player must keep the scoring dice. If all 10 color dice 100 score, the player may roll the CupTin over again, but risk the chance of bunking. The player chooses when to Park and Mark. The WPD is worth an optional 100 points, the player may add it to his score or push it back into the CupTin for re-rolling.

"The Long Journey"

A second variation, suitable for more experienced players, has a Post of 900 and a Goal of 20,000. Journey players may decide if the goal is higher than 20,000. Each player starts with 5 saucers 310. Otherwise, the rules for The Long Journey are the same as The Short Trip.

"The Purist Game"

A third variation, suitable for seasoned players and "Purists," has a post of 800 and a Goal of 15,000. Each player blindly chooses 1 color die 100 from the CupTin 206 and rolls it for their WPD of the game. Certain Purist players may choose to keep their WPD forever, not re-rolling for subsequent Purist games. The Purist game utilizes the game coin 530, which is won by scoring a Greshem only. Purist players Go for Greshem whenever possible. The player with the lowest WPD starts, and play continues counter-clockwise. Saucers 310 are not used. Rather, the Greshem gold coin 530 is used, as described above in the Greshem House Rules.

The scoring is similar to The Short Trip and The Long Journey with a few differences.

The Red Six, are wild for all players and score an extra 100 each, but scoring is optional.

Toss-A-Coin, as explained above, the Greshem Gold Coin 530 may be used when available to de-bunk.

Extra Game Variations

"Clip'N"

As described above, the saucers 310 can be linked together. Very young children may link together various saucers 310 to create various structures. Young children may also wish for their creations to remain assembled. The Clip'N game allows any saucer creation to stay assembled for 5 days or until the next Greshem game is played.

"Cube'N"

Younger players may not wish to play the Greshem games, which have more complicated rules, or may have trouble with the addition involved in scoring. The color cubes 640 may be used for the Cube'N game, which is a game of matching color. Each player gets 3 rolls to try to get all five color cubes 640 to match, or roll the same color. White stars 646 may be re-rolled, even on the last roll, but may not be substituted as a color. After the first roll, the player chooses which specified color to continue to roll for, and rolls the color cubes 640 which did not roll that color. On the second roll, the color cubes 640 which match remain, and the remaining color cubes 640 are re-rolled. On the third roll, if all the color cubes 640 do not match, the next player plays. However, if the white star lands on the third roll, the player may re-roll the white star die 646 again. A player may choose to go for "ALL STARS" if at least one star appears in the first roll, but they are no longer wild and that player only gets three rolls. Any five matching cubes win.

"Cubers"

Young players may have difficulty with arithmetic, but may still know colors and simple math. Cubers is a game of matching pairs, played with the color cubes 640 and the number cubes 750. The colors of the color cubes 640 correspond to numbers: red=1, yellow=2, green=3, blue=4, purple=5 and star=6. The winning Goal number is set by the players each game. Cubers use some Greshem rules, except you "score" or set aside matching number pairs, with the number being the score. The matching pairs are set aside, and the remaining cubes are re-rolled. Players choose when to Park and Mark.

Unless otherwise stated, all measurements, values, ratings, positions, magnitudes, sizes, locations, and other specifications, which set forth in this specification, including in the claims that follow, are approximate, not exact. They are intended to have a reasonable range, which is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description, which shows and describes the illustrative embodiments. As will be realized, these embodiments are capable of modifications in various obvious aspects, all without departing from the spirit and scope of the present disclosure. Accordingly, the detailed description is to be regarded as illustrative in nature and not restrictive. Also, although not explicitly recited, one or more additional embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A dice and board game comprising: providing a game board, a set of indicator cubes, and four or more saucers; wherein said game board comprises: a primary playing surface, a plurality of cubbies, a plurality of colored sections, an inner wall, and an outer wall; wherein said primary playing surface comprises a marking and is surrounded and defined by said inner wall; wherein said plurality of cubbies and said plurality of colored sections are located on an outer perimeter of said game board and are located in between said inner wall and said outer wall; wherein said plurality of cubbies and said plurality of colored sections alternate along said outer perimeter of said game board and are separated by a plurality of partitions; wherein said set of indicator cubes comprises: a plurality of color indicator cubes, a plurality of number indicator cubes, and five sets of colored dice; wherein each of said plurality of color indicator cubes comprise five colored sides and one symbol side; wherein each of said five color sides is a different color; wherein each side of said plurality of number indicator cubes has a different number between the numbers 1 and 6; determining by two or more players a predetermined winning score; receiving by each of said two or more players: one of said plurality of color indicator cubes, one of said plurality of number indicator cubes, and at rolling by each of said two or more players said one of said plurality of color indicator cubes and said one of said plurality of number indicator cubes, and determining which of said two or more players begins playing first, such that there is a first player and at least one subsequent player; simultaneously rolling by said first player said five sets of colored dice onto said primary playing surface; dividing said rolled five sets of colored dice into a first subset and a second subset, such that said first subset comprises scored dice and said second subset comprises unscored dice; wherein if said first subset comprises no scored dice a turn of said first player is bunked; wherein if said first subset comprises a plurality of scored dice, said first player has an option to roll said unscored dice or keep a score related to said scored dice; wherein if said player keeps said score related to said scored dice said turn of said first player is over; wherein if said first player rolls said unscored dice, said unscored dice are then divided into a third subset and a fourth subset, such that said third subset comprises scored dice, which are then combined with said first subset, and said fourth subset comprises unscored dice, wherein so long as said third subset comprises at least one scored dice, said first player continues to have said option to roll said unscored dice or keep said score related to said scored dice; wherein if said third subset comprises no scored dice a turn of said first player is bunked; wherein once said turn of said player is over, play passes to said at least one subsequent player, who rolls said five sets of colored dice just as said first player did; continuing to pass play between said two or more players until one of said two or more players obtains said predetermined winning score and ends said game.

2. The dice and board game of claim 1, further comprising: allowing said first player to continue said turn after being bunked by using one of said at least two saucers received by said first player in association with said marking on said game board.

3. The dice and board game of claim 2, further comprising: earning an additional saucer by said first player if said first player has used all of said at least two saucers received when said first player rolls said five sets of colored dice such that one or more of said colored dice lands within one or more of said colored sections, such that one or more stray colored dice are created, and such that a color of at least one of said one or more stray colored dice matches a color of said one or more colored sections in which said one or more stray colored dice lands.

4. The dice and board game of claim 3, wherein said scored dice comprises one or more triple links.

5. The dice and board game of claim 4, wherein said scored dice further comprises one or more single hooks.

6. The dice and board game of claim 5, wherein said scored dice further comprises at least one scoring combination selected from the group of scoring combinations consisting of one or more sparks, a toledo, a holy toledo, a brooklyn, a wild push dice match, and a greshem.

7. The dice and board game of claim 6, wherein said wild push dice match occurs when at least one of said scored dice matches both said one of said plurality of color indicator cubes and said one of said plurality of number indicator cubes.

8. The dice and board game of claim 7, wherein rolling a greshem wins and ends said game.

9. The dice and board game of claim 8, wherein each of said two or more players must score a minimum opening score in order to begin scoring.

10. The dice and board game of claim 9, wherein after each roll of said unscored dice and after each roll of said complete five sets of colored dice, said scored dice must be scored.

* * * * *